United States Patent [19]

Huthwelker et al.

[11] 4,317,856

[45] Mar. 2, 1982

[54] INSULATING-MATERIAL BODIES HAVING METAL PARTICLES DISPERSED IN THE RESIN

[75] Inventors: Dirk Huthwelker, Troisdorf; Arnold Franz, Troisdorf-Spich; Siegfried Köpnick, Troisdorf, all of Fed. Rep. of Germany

[73] Assignee: Dynamit Nobel AG, Troisdorf, Fed. Rep. of Germany

[21] Appl. No.: 99,224

[22] Filed: Nov. 30, 1979

[30] Foreign Application Priority Data

Dec. 4, 1978 [DE] Fed. Rep. of Germany ..... 2852375

[51] Int. Cl.[3] ..... B32B 15/00

[52] U.S. Cl. ..... 428/273; 427/96; 427/97; 427/98; 427/304; 427/305; 427/306; 427/370; 427/389.9; 427/389.8; 428/242; 428/263; 428/264; 428/268; 428/275; 428/285; 428/426; 428/432; 428/457; 428/464; 428/532; 428/537; 428/901

[58] Field of Search ..... 427/304–306, 427/390 R, 390 A, 370, 331, 96, 97, 389.9, 389.2; 428/432, 268, 426, 273, 464, 275, 457, 532, 242, 263, 283

[56] References Cited

U.S. PATENT DOCUMENTS

| | | | |
|---|---|---|---|
| 3,930,109 | 12/1975 | Brandt et al. | 427/306 |
| 3,956,535 | 5/1976 | Lozier | 427/306 |
| 3,998,602 | 12/1976 | Horowitz et al. | 427/306 |
| 4,002,779 | 1/1977 | Nischwitz | 427/306 |
| 4,004,051 | 1/1977 | Kadison | 427/306 |
| 4,017,265 | 4/1977 | Taylor | 428/675 |
| 4,035,500 | 7/1977 | Dafter | 427/306 |

*Primary Examiner*—Norman Morgenstern
*Assistant Examiner*—Janyce A. Bell
*Attorney, Agent, or Firm*—Sprung, Felfe, Horn, Lynch & Kramer

[57] ABSTRACT

The inclusion of metal particles finely and essentially statistically distributed in an insulating-material body which can be coated with a metal without use of an electric current is described wherein a solution of a reducible metal compound of a metal of Group VIII or Ib is employed. The solution can be added to a resin impregnating solution for the insulating material or to the adhesive of one or more adhesive layers in the insulating material. The solution of metal preferably contains a small amount of ammonium chloride.

5 Claims, No Drawings

INSULATING-MATERIAL BODIES HAVING METAL PARTICLES DISPERSED IN THE RESIN

BACKGROUND OF THE INVENTION

1. Field of the Invention

This invention relates to insulating-material bodies being a laminate of a plurality of sheets and, in case, a surface layer, at least one of said sheets or the surface layer, containing therewithin finely and essentially statistically distributed particles of metals of Group VIII or Ib of the Periodic Table of the Elements and to methods for producing such insulating bodies by introducing into a resinous impregnating solution of a prepeg or into the adhesive of a surface layer a solution of a reduicable metal compound of a metal of Group VIII or Ib of the Periodic Table, said metal compound distributed in the resin or adhesive being reduced to finely distributed metal particles when a lay-up of sheets and, in case, a surface layer are cured under heat and pressure to form the laminate. Where the insulating-material body contains reducible metals in the form of compounds, e.g. salts of Group VIII or Ib of the Periodic Table of the Elements the metal itself is formed in fine distribution when the resin bond laminate is produced by exposure to heat and pressure.

This invention is particularly concerned with the production of insulating-material bodies for use in the production of printed circuits for circuit boards with wholly or partially metallized surfaces, and in particular to insulating-material bodies with perforations whose inner walls are provided with a metal coating, which is deposed on the surfaces of the insulating bodies by the catalytical activity of said metal particles being exposed in the outer surface and inner walls of the insulating bodies.

2. Discussion of the Prior Art

It is known to treat the surfaces of insulating areas with solutions of reducible metals followed by a solution of reducing agents, the so formed reduced metal germs permit conductive patterns of printed corcuits to be applied in numerous steps. Improved insulating-material bodies are obtained, according to the proposals of German Offenlengungsschrift DOS No. 26 12 637, German Pat. No. 16 96 602 and German Auslegeschrift DAS No. 16 96 604, by adding catalytically active fillers to the resin mixture used to produce the insulating material. The catalytically active filler exposed at the surfaces and at the inner walls of the perforations brings about deposition of a metal coating of the insulating-material substrate from precipitating metal baths without the use of electric current.

These catalytically active fillers must be prepared from special fillers of a particular particle size in several separate operations involving the deposition of metal compound solutions, reducing the metal compounds to metal particles and drying of the fillers. Moreover, the introduction of the fillers into the resin solutions and their handling require special procedures. Yet there is no assurance that the fillers will be uniformly dispersed in the insulation material since even filler particles of small size are not uniformly dispersed in the impregnating solution and settle out.

The so formed insulating-material bodies having catalytically active metal particles inside and ready for forming metal coatings from a metal salt bath on parts or the total of their surface, clearly have deciseive disadvantages and problems not being dissolved by the art:

when surfaces of ready preformed insulation bodies are surface treated with metal solutions, only such parts near the surface will contain the catalytically active metal germs, while the numerous holes and and fine borings of an electrical circuit have not enough or no metal germs, and when metal germs deposited on fillers divided in the resins, the filler-bond metal germs are not finely enough divided in the resin as even finely derived filler bodies are too big for this purpose and additionally, the separate production of filler-bond metal germs and dispersing then in a resin solution is rather costly.

SUMMARY OF THE INVENTION

The foregoing objects are solved in accordance with this invention which provides a method of producing surfaces of insulating-material bodies suited for the deposition of metal without the use of electric current by the use of one or more metal compounds of Group VIII or Ib of the Periodic Table of the Elements, which are reducible to metals. The invention involves the addition of a solution of said metal compounds to a solution of a resin or to an adhesive of an surface layer, said solution of the resin being the resin impregnation solution, when prepregs of a multi layer laminate of a insulationg-material body are formed.

While, as seen from the state of the art, said metal compounds or solutions thereof have formerly not been added to the resin solution, as the metal compounds are not soluble therein, solvents mostly are not compatible with concentrated resin solutions and the reduction to metal germs is not necessarily secured during the curing process of the resins, the invention will more clearly understood by the following:

A fairly large number of such compounds reducible to metals is known. They are mostly salts of the metals of said groups. Of the metals, silver, cobalt, nickel, platinum and palladium whose salts are preferred for practical reasons in this use, palladium is particularly preferred, and of its salts, especially palladium chloride. Generally, these metals are present in the solutions which are added to the resin solution employed for impregnation in an amount of at 1 to 10 weight percent, preferably 3 to 6 weight percent, calculated as the metal.

The metal compound, in solution form, should be added in amounts ranging from 0.01 to 3 weight percent, and preferably from 0.025 to 0.08 weight percent, of the metal compound, based on a 100 weight percent solids content of the resin solution.

It is important to select from the metal-compound solution a solvent which is capable of dissolving large amounts of metal compound and at the same time possesses the requisite compatibility with the resin solutions, which are sensitive to additions of foreign matter.

Water is decidedly preferred as solvent. Other solvents that are compatible with resin solutions may, in exceptional cases, be used as cosolvents but should be used as exclusive solvents only in special situations. These other solvents include: lower alcohols of 1 to 4 C-Atoms, as methanol or ethanol or acetone. The solution contains 0.05 to 10 wt.% of the metal compound.

It has surprisingly been found that the addition of ammonium chloride substantially reduces the amount of water needed for dissolving the metal compound, especially when palladium chloride is used as reducible metal compound. The electrical properties of the insulating-material bodies produced are not impaired by the ammonium chloride since it is added in a small amount and evidently is eliminated at the elevated drying and curing temperatures of the insulating-material bodies.

The amount of ammonium chloride used should be about 1.5 to 2.5 times the weight of the metal compounds. It contributes decisively to the solubility of palladium chloride especially in water and also in other polar solvents. This makes it possible to keep the amount of water added with the solution of metal compounds within the 2 to 5 weight percent range, depending on the resin system used, which is compatible with the resins. Moreover, the metal salt so dissolved is stable in the resin solution, that is to say, no $PdCl_2$ will precipitate out.

In accordance with the present invention, the separate addition of a reducing agent surprisingly is not necessary in the case of resol resins since the aldehyde, e.g., formaldehyde, of the phenol or cresol resols, for example, is sufficient to bring about the reduction of the metal salts, and particularly of the palladium salts, to metallic palladium in the heat treatment.

If a resin is used which does not contain formaldehyde, for example, an epoxy resin system or another conventional resin, formalin or other source of formaldehyde is added to the resin solution as reducing agent. A small amount of miscible resin containing formaldehyde, such as a phenol or cresol resol, can be added to such resins, whereby the formaldehyde functions as reducing agent. However, other known reducing agents may also be used in such cases.

The object of the invention may also be accomplished by adding the solution of the metal compound in water and/or another compatible solvent to the adhesive of one or more adhesive layers on or, optionally, in the insulating-material body. Said adhesive layer may form, in particular, one or both surface layers and comprising a metal sheet or paper layer coated with said adhesive.

The kind and amount of the metal compounds here are the same as in the addition to the resin solution, palladium chloride again being particularly preferred, and the amounts generally ranging from 0.01 to 3 weight percent, based on the solids content of the adhesive.

When the adhesive exhibits low compatibility with water, the amount of ammonium chloride in the solution may and should be increased to as much as 3.5 times the weight of the metal compound.

Formalin or, optionally, other reducing agents which in the following heat treatment result in a very fine dispersion of the metal particles may be added to the adhesive.

Optionally, the metal componds reducible to metals may be added only to the resins optionally to only one of two or more used resin solutions or to the adhesive or, if necessary, to both resins and adhesives of an insulating-material body.

The present method offers the advantage of considerable simplification of the manufacturing process of the insulating-material bodies since a great many process steps, such as those necessary for the preparation of special fillers or for the aftertreatment of the surface with metal-salt solutions, are dispensed with.

The present method further offers the advantage of completely uniform deposition of extremely fine metal particles in the resin layer or adhesive layer, an added advantage being that during the manufacturing process of the laminated bodies the metal compounds of the resin binder or of the adhesive penetrate also into the reinforcement layers of the insulating-material body which during its manufacture were not provided with solutions of the metal compounds.

Through the present method, the metallization of insulating-material bodies without the use of electric current is considerably facilitated and improved both in the surface layers and, especially, in existing or subsequently produced holes, cutouts or recesses through the fine and uniformly dispersed metal particles produced in accordance with the invention. A special advantage is that relatively small amounts of metal suffice for production of the catalytically active metal germs.

It should be understood that the insulating-material bodies produced in accordance with the invention include all substrate materials, generally flat, which are used to make printed circuits, circuit boards, etc., by the deposition of metals without the use of electric current and to form metallic conductors wherein at least one of the layers which they comprise was formed by the use of a resin solution or of an adhesive layer or was applied to an insulating-material body of any type, and wherein at least a portion of the resins or of the adhesive used was provided in accordance with the invention with a metal-compound solution. Said insulating-material bodies thus include, in particular, insulating-material bodies fabricated from laminates produced from sheets or webs of cellulosic or glass fiber materials by impregnation with resin solutions and drying, sections or sheets thereof being cured and hardened under heat and pressure of the resins, one or more or a plurality of such pressed sheets, as well as insulating-material bodies which in addition comprise surface layers or intermediate layers made of other materials.

Insulating-material bodies within the meaning of the invention further include prepregs in the dried state, laminates made therefrom, and flat materials, regardless of how produced, having laminated thereto, pressure-mounted thereon or adhesive-bonded thereto one or more layers incorporating metal compounds added thereto in accordance with the invention either in the as yet unreduced state or, preferably, in the reduced state in the form of finely dispersed metal particles.

In the case of multilayer insulating-material bodies, one or both surface layers, or one or both subsurface layers, usually is or are provided with the metal salt solutions or the finely deposited metal particles, although layers disposed in the interior of the insulating-material body may also be provided with metal compounds or finely deposited metal particles. This results in advantages especially in the case of holes or cutouts which subsequently are to be provided with metallic conductive layers.

The subject matter of this application thus includes insulating-material bodies comprising at least one insulating-material layer or adhesive layer incorporating dissolved metal compounds which have been added thereto, or finely dispersed metal particles produced by the reduction thereof, regardless of the materials from which and of the methods by which the other components of said insulating-material bodies have been produced.

The metals or metal compounds being statistically distributed in at least one part of resin portion or adhesive of the insulating-material bodies, not being deposited in or on foreighn solid bodies as fillers or ion exchangers, which solid bodies are not present in the resin or resin solution or adhesive according to the invention.

The subject matter of this application further includes the use of insulating-material bodies in the production of printed circuits, circuit boards or the like by the further deposition of metal coatings, in particular without the use of electric current but also conventionally by the galvanic route.

The process for production of such laminates and prepregs i.e. reinforced resin layers or sheets is well known in the art in so far, as no metals or metal compounds are added before the ready laminate, being one of usual resin containing insulation bodies, has been produced.

Usually a reinforcing material comprising a web of cellulosic material as paper or wood fiber layers or synthetic material webs of glass fiber or organic synthetic fibers is brought into contact with a first resin solution, being sprayed or brushed or rolled, so being contributed a controlled amount of resin, of say 5 to 20 wt-% of the web, or impregnated by a maximum of resin by immersion. The resins of said first step are often water soluble or solved in water and organic solvents and having 4 to 30 or more wt.% of solid resins, most times said resins being of lower molecular weight, containing at least parts of resins having molecular weights of 2 to 6 monomer units and often being phenol or resol formaldehyde resins or containing these and further resins.

Said impregnated webs are impregnated again by immersion i.e. saturation with a resol resin solution, said solution having a higher resin content to 40 to 80 wt.% of solid resin and the solvent thereof being a non aqueous solvent, mostly aceton, but being compatible mostly with a certain small amount of water. The resin of this second solution are of higher molecular weight, generally containing no or nearly no particles of 2 to 6 monomer units, most particles having 10 up to say 50 or 100 monomer units.

The impregnated webs are dried after the first and after the second impregnation, or only one time after the second impregnation at 150° to 170° C. The amount of solid resin being 90 to 150 wt.%, based on the weight of the dry reinforcing web. The kind of resins at the first step mostly will be a phenol or cresol resol resin, at the second step such a resol resin or a epoxy resin but further resins or resin mixtures may be used, such as polyester resin, usea and melamine resins etc. In the resins plasticizers, flame retardents and modifying additives may be present in controlled amounts.

The metal compounds solutions according the invention are added to both or optionally only to the second resin solution. The impregnated and dried webs are cut to prepregs, one, more or a plurality are layed up and form a laminate after curing the resins by simultaneous exposure to heat of 150° to 180° C. and pressure of 80 to 120 kg/cm$^2$ for 40 to 90 minutes.

In order to more fully illustrate the nature of the invention and the manner of practicing the same, the following examples are presented:

EXAMPLE 1

On a continuously-operating laminate-impregnating machine, a paper web was first impregnated with a preimpregnating resin (such as Phenol Resol 2448 of Bakelite) and then dried at 150° to 170° C., a resin coating of 20 weight percent being thus applied.

The paper web so pretreated was then reimpregnated in accordance with the invention with the resin solution specified below, which resulted in a total resin application of 120% after drying.

The second resin solution had the following composition:

| | | |
|---|---|---|
| Wood-oil-modified phenol-resol resin | 80 wt. % | solids content |
| Phosphate plasticizer | 20 wt. % | |
| $PdCl_2$ | 0.1 wt. % | metal compound solution |
| $NH_4Cl$ | 0.2 wt. % | |
| Water | 2 wt. % | |

The phosphate plasticizer used was cresyl diphenyl phosphate.

As used metal-compound solution, a solution of 100 parts water containing 5 g $PdCl_2$ and 10 g $NH_4Cl$ was prepared by heating to 40° C. and added to the resin solution at the rate of 2 Wt. % per 100 wt. % of the resin solution. This resin solution was found to have the requisite storage stability.

After the second application of resin, the paper web was dried at 170° C., conventionally cut up into prepregs, and stored for further processing. The laminates made therefrom were found to be metallizing satisfactorily.

EXAMPLE 2

Analogously to Example 1, a paper web was first spray-coated with 10 wt. % of the resin specified in Example 1 and then, without prior drying, impregnated with a resin solution composed of 75 wt. % phenol-resol resin (resin solids) and 25 wt. % tricresyl phosphate to which 1.5 wt. % of a $PdCl_2$ solution of 100 parts water containing 2.5 parts $PdCl_2$ and 6 parts $NH_4Cl$ had been added. Drying was carried out at 160° C. The total resin application was 130%, based on the weight of the paper web.

EXAMPLE 3

A solution of 5 parts by weight $PdCl_2$ and 10 parts by weight $NH_4Cl$ in 100 parts water was prepared and added to an epoxy resin solution (97% epoxy resin DER 652 of Dow Chemicals and 3% dicyanodiamide) together with 2 parts of a 37 wt. % formalin solution at the rate of 1 wt. % per 100 parts.

Following impregnation and drying at 170° C., a glass-fiber prepreg with a 40% resin content was obtained.

The prepregs were then processed on a hot press into laminates on which a uniform copper layer free of flaws was deposited in a metallizing bath in a relatively short time.

EXAMPLE 4

To an adhesive on an acrylonitrile-butadiene-phenol-resol resin bases (BN 173 of the Dr. Hesse company) there were admixed per 100 parts 2.5 parts of a solution of 1 part $PdCl_2$ and 2 parts $NH_4Cl$ in 100 parts of water. The adhesive was applied:

(a) By dipping laminates, optionally with a resin binder of polyester, polyepoxy or phenol-formaldehyde resin in the laminate, in the adhesive and drying them in a circulating-air oven at 150° C. for 1 hour.

(b) By coating aluminum foil with the adhesive and pressing it together with a laminate.

(c) By coating a special substrate sheet with it by means of doctor blades in a layer 40μ thick (German patent application No. P 28 09 917.4) and pressing it together with a laminate.

EXAMPLE 5

Example 1 was repeated, except that in place of $PdCl_2$ the same amount of $PtCl_2$ was added to the resin solution.

The prepregs and laminates so produced can be metalized in accordance with Example 1, and with similar results.

We claim:

1. In a process for the formation of a resin containing insulating body containing reduced metal particles which body can be electrolessly coated with a metal, the insulating body being produced by impregnating webs of cellulosic material or glass fiber webs with one or more resin solutions, drying the impregnated web, and curing one or a plurality of sections of the dried web under heat and pressure, the improvement wherein to at least one of said resin impregnating solutions there is added an aqueous ammonium chloride containing solution of 0.01 to 3 weight percent, based on the weight of solids in said resin impregnating solution of a reducible metal compound of Group VIII or Ib of the Periodic Table of the Elements, said ammonium chloride being present in said solution in an amount of 1.5 to 2.5 times the weight of said reducible metal and reducing said metal compound to metal particles finely divided within the cured resin portion of the insulating body by drying and heating.

2. A process according to claim 1 wherein the reducible metal is a palladium salt.

3. A process according to claim 2 wherein said palladium salt is palladium chloride.

4. A process according to claim 1 wherein said reducible metal compound is added to said resin containing solution in an amount of 0.025 to 0.08 weight percent, based on the weight of the solids content of said resin coating solution.

5. An insulating body containing therewithin the fine and uniformly distributed particles of a metal of Group VIII or Ib of the Periodic Table of the Elements produced by the process of claim 1.

* * * * *